United States Patent [19]

Potter et al.

[11] 4,169,618

[45] Oct. 2, 1979

[54] PLASTIC DOOR LOCK

[75] Inventors: Dennis G. Potter; Hagen Dietrich, both of Delta; Joseph Potschka, Vancouver, all of Canada

[73] Assignee: Norris Industries, South Gate, Calif.

[21] Appl. No.: 853,201

[22] Filed: Nov. 21, 1977

Related U.S. Application Data

[63] Continuation of Ser. No. 712,898, Aug. 9, 1976, abandoned.

[51] Int. Cl.[2] ..... E05C 1/12; E05B 3/08

[52] U.S. Cl. ..... 292/169.15; 292/336.5

[58] Field of Search ..... 292/169.14, 169.15, 292/169.16, 169.17, 169.18, 169.19, 169.21, 169.22, 169.23, 347, 348, 349, 350, 351, 352, 353, 354, 355, 356, 357, DIG. 38, DIG. 53, 336.5

[56] References Cited

U.S. PATENT DOCUMENTS

| | | | |
|---|---|---|---|
| 2,709,911 | 6/1955 | Russell | 292/347 |
| 2,741,502 | 4/1956 | Crandell | 292/348 X |
| 3,075,797 | 1/1963 | Patriquin et al. | 292/DIG. 38 X |
| 3,105,712 | 10/1963 | Duvall | 292/169.17 |
| 3,125,366 | 3/1964 | Cetrone et al. | 292/169.15 X |
| 3,179,459 | 4/1965 | Lint | 292/356 |
| 3,186,747 | 6/1965 | Hamm et al. | 292/169.14 |
| 3,240,040 | 3/1966 | Wilson | 292/169.17 X |
| 3,580,622 | 5/1971 | Morgan | 292/357 X |
| 3,724,888 | 4/1973 | James | 292/DIG. 38 X |
| 3,858,918 | 1/1975 | McBurnie et al. | 292/169.15 |

FOREIGN PATENT DOCUMENTS

| | | | |
|---|---|---|---|
| 955978 | 10/1974 | Canada | 292/DIG. 38 |
| 978232 | 11/1975 | Canada | 292/DIG. 38 |
| 2529850 | 1/1976 | Fed. Rep. of Germany | 292/DIG. 38 |

*Primary Examiner*—Thomas J. Holko

[57] ABSTRACT

A plastic door lock, sometimes referred to as a door latch, makes use of moldable plastic material for most of the individual parts of the lock assembly with opposite roses adapted to interlock with each other and be held together with a single screw on the axial center line of the knobs and accessible from the outside. When used as a privacy lock unlocking the lock from the outside is prevented by pushing the inside knob into a releasable but non-rotatable engagement with the inside rose. A lost motion connection between the latch bolt and roll back spindle allows the door to be closed without damage to the latch bolt when the inside knob is locked. Inherent resiliency in the material of the latch bolt case, in cooperation with the movable latch bolt, releasably returns and holds the latch bolt in extended position.

20 Claims, 24 Drawing Figures

PLASTIC DOOR LOCK

This is a continuation of copending application Ser. No. 712,898 filed Aug. 9, 1976, now abandoned.

Although there has recently been great stress laid upon the security feature of locks there are sundry types of installations where security is not of primary consequence. Despite the lack of stress on the security feature, locks for such purpose do need to be dependable, namely to open and close when needed, in a reliable fashion, for long periods of use. Some installations also have need for what is commonly known as a privacy lock, namely one which can be locked or blocked on the inside for temporary security but which can be released from the outside, in case of an emergency, by some conventional tool such as a screw driver or ice pick, for example. Installations of the type suggested are often adequately supplied by locks of less costly construction and where installations can be quickly and easily made by persons of no more than modest skill. Areas where such locks are in demand include interior doors of recreation vehicles, campers, trailers, temporary housing, closet doors and the like where a door needs to be shut and held shut but wherein no attempt is made to provide a lock greatly resistant to tampering and unauthorized entry.

With the advent of dependable synthetic plastic resin material there has been a progressive substitution of the plastic resin material for some of the working parts of locks. By proper design more and more of the metallic components of a lock can be dispensed with in favor of plastic components. The fact does remain, however, that plastic material does have limitations in that it cannot be made in sections as thin as metallic material and on other occasions falls short of the strength which might be required. Moreover if full advantage is to be taken of the use of plastic material it is important to minimize the number of separate components without sacrificing the number of functions performed by each so that such a lock made substantially of plastic components can be sold in great quantities therefore at an acceptable price advantage.

It is therefore among the objects of the invention to provide a new and improved substantially all plastic lock which is simple, dependable and relatively inexpensive and which at the same time functions smoothly and with a sufficient degree of security to be a useful locking expedient.

Another object of the invention is to provide a new and improved substantially all plastic lock which is capable of serving as a privacy lock, capable of emergency release by simple available means.

Still another object of the invention is to provide a new and improved substantially all plastic lock, outside and inside plate and knob assemblies of which can be attached to each other in place on a door by use of only a single centrally located fastening means.

Still another object of the invention is to provide a new and improved lock wherein substantially all of the components are of plastic material so constructed that there is adequate stability provided for the knobs in their relationship with respect to the rose or mounting assembly and an appropriate interlock between opposite rose assemblies which takes place simultaneously with the mounting of the rose assembly on the door.

Still another object of the invention is to provide a new and improved lock of substantially all plastic components wherein the number of components is kept substantially to a minimum by reason of building into the main components as integral parts, those parts which normally have existed as separate independent components.

Still another object of the invention is to provide a new and improved lock of substantially all plastic components wherein a metallic spring for returning the latch bolt to extended position has been dispensed with in favor of a new and improved plastic return mechanism with virtually a minimum number of individual separate components.

With these and other objects in view, the invention consists of the construction, arrangement and combination of the various parts of the device, whereby the objects contemplated are attained, as hereinafter set forth, pointed out in the appended claims and illustrated in the accompanying drawings.

Figures 1, 2:
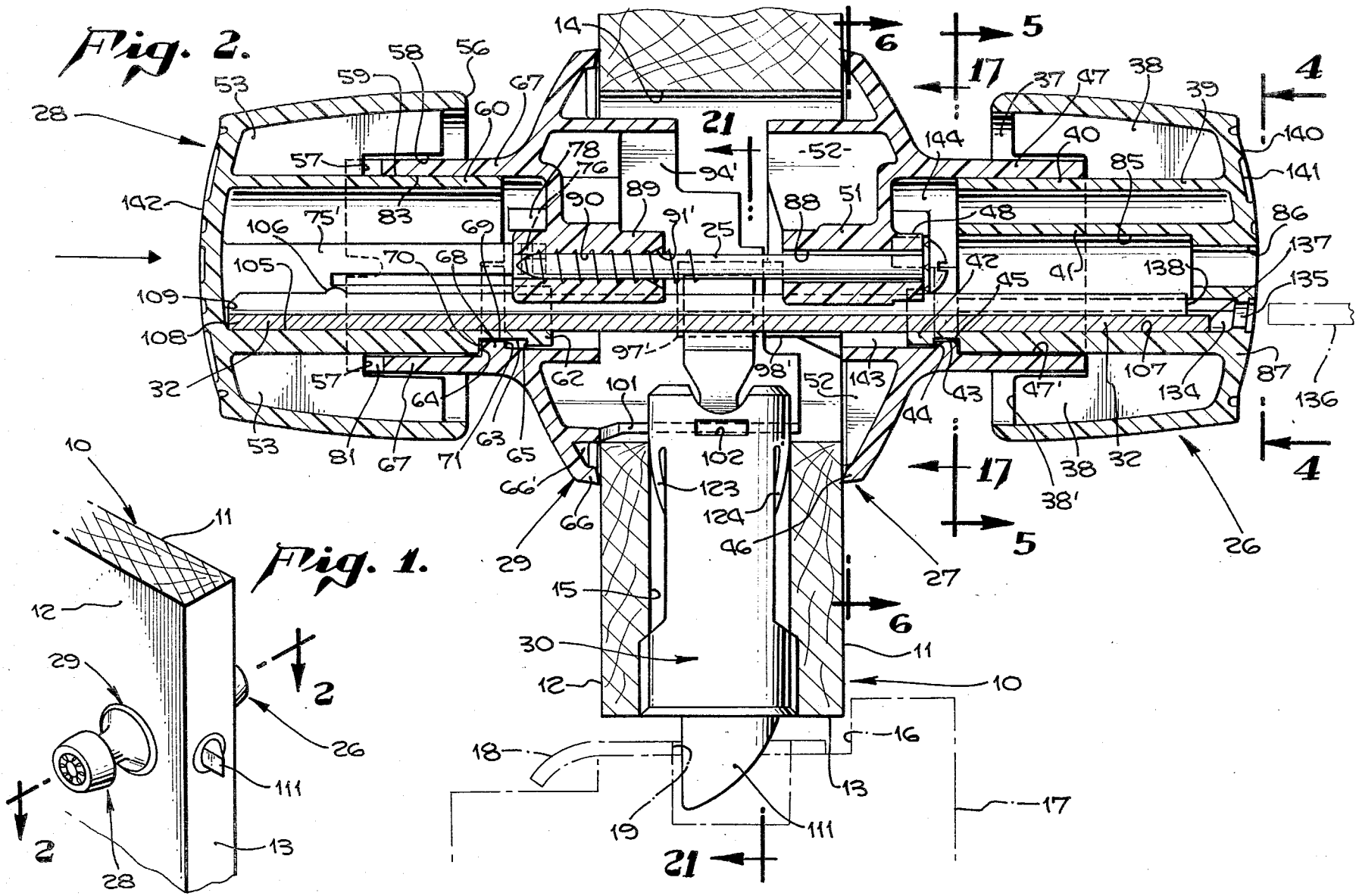
FIG. 1 is a fragmentary perspective view of a section of door showing the plastic privacy lock installed.
FIG. 2 is a longitudinal sectional view on the line 2—2 of FIG. 1.

In an embodiment of the invention chosen for the purpose of illustration, a lock is shown in FIGS. 1 and 2 installed on a door 10 which has an outside face 11, an inside face 12 and a side edge or edge face 13. An opening 14 extends through the door between the outside and inside faces. A bore 15 extends from the edge face 13 into the opening 14. The door 10 is adapted to swing against a door stop 16 in a door frame 17, the frame being provided with a conventional strike plate 18 having the customary latch bolt opening 19 in it. The parts described up to this point are found on virtually all types of doors in which the door lock of the invention is installed.

Figure 3:
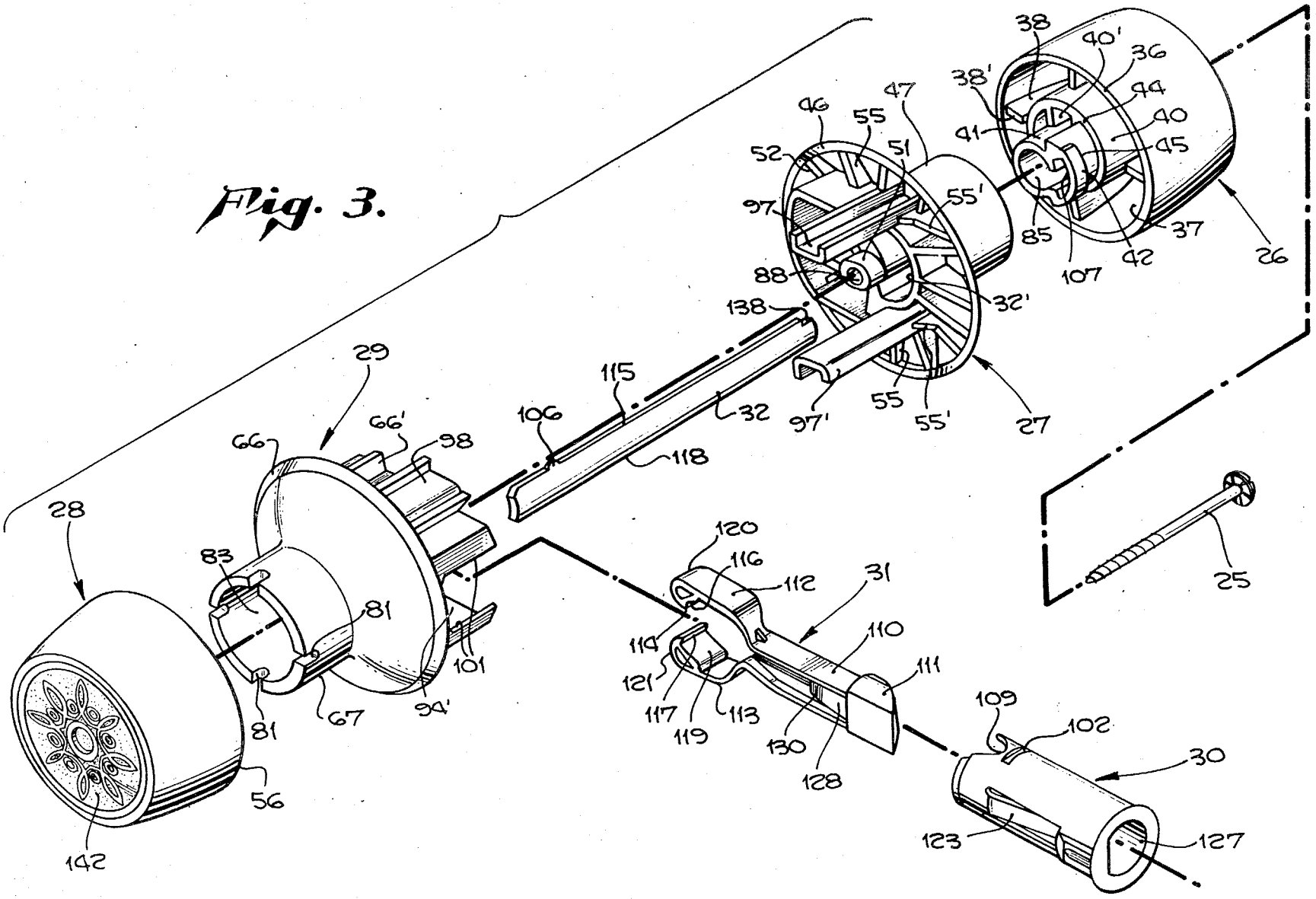
FIG. 3 is an exploded perspective view of all the individual parts.
Figure 5:
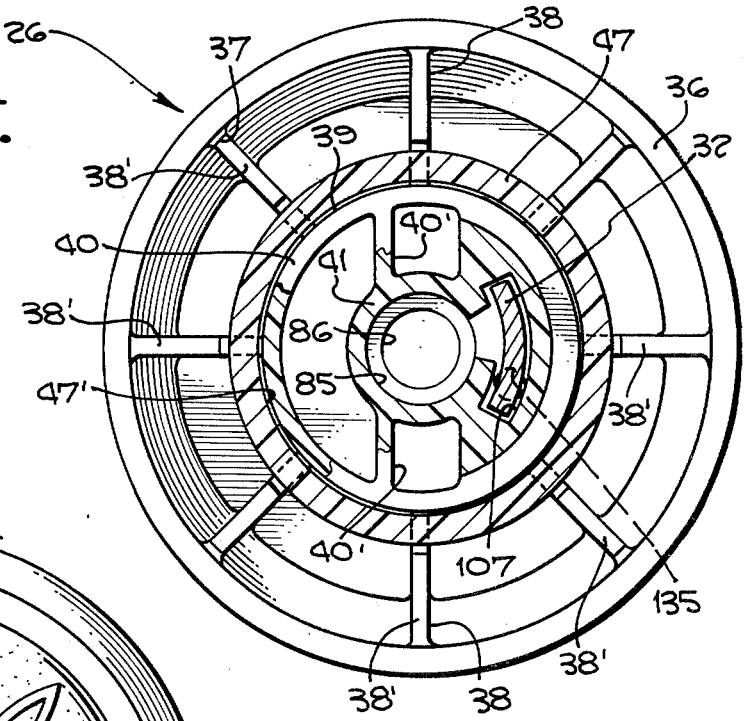
FIG. 5 is a cross-sectional view on the line 5—5 of FIG. 2.

In the embodiment of the invention chosen for illustration there are seven parts for the door lock all of which are individually shown in FIG. 3 together with a conventional mounting screw 25. All parts of the lock are of a synthetic plastic resin material except for the spindle 32 and the mounting screw 25 which, in the present embodiment are of metal. An outside subassembly consists of an outside knob 26 and outside rose or mounting plate 27. An inside subassembly consists of an inside knob 28 and inside rose or mounting plate 29. A latch bolt assembly consists of a case 30 and latch bolt 31. All parts of the subassemblies just described are constructed of an appropriate synthetic plastic resin. Cooperating with the outside and inside subassemblies is a spindle 32 which is preferably metal but which can be of an appropriate plastic material.

As shown in FIGS. 2, 3, 4, and 5 the outside knob 26 has an inside end 36 in which is an annular recess 37 formed by inner ends 38' of fins 38 and the wall 39 of a sleeve-like protruberance 40. The protruberance 40 stiffened by fins 40' extends axially inwardly of the inside face 36. Concentrically disposed within the protruberance 40 is an inner sleeve 41, at the inner end of which is an arcuate projection 42 separated from the remainder of the inner sleeve 41 by a recess 43. The recess forms an outwardly facing shoulder 44 and an inwardly facing shoulder 45. By reason of the character of the material and the length of the inner sleeve there is a degree of flexibility.

The outside rose 27 has an annular rim 46 which is adapted to press against the outside face 11 of the door. The rim may be pitched slightly inwardly so that its outside edge may bite slightly into the face of the door. Extending axially outwardly from the rim is a bearing sleeve 47 having an inside bearing surface 47'. The bearing sleeve extends into the recess 37 where the wall 39 on the protruberance 40 is adapted to bear as the knob is rotated relative to the rose. A boss 48 is an extension of a centrally disposed mass 51 molded integrally with the rose 27 to which the mass is attached by sundry radially disposed fins 52. The mass 51 and portions of the fins 52 project inwardly relative to the outside face 11 of the door. An enlarged arcuate clearance 32' in the outside rose provides room for the spindle to rotate. Outer ribs 55, 55' provide additional rigidity.

Extending inwardly into the inside knob 28 from an inside end 56 is a series of recesses 57 each formed by a wall 58 of a fin 53 and the exterior of a somewhat sleeve-like protruberance 60. Alternate fins 54 are cut deeper. At the inner end of the protruberance 60 is an arcuate projection 62. The projection is separated from the remainder of the protruberance by a relatively wide recess 63 which provides an outwardly facing shoulder 65 and an inwardly facing shoulder 64.

On the inside rose 29 is an annular rim 66 which is adapted to bear against the inside face 12 of the door. The rim may also be pitched slightly inwardly so that its outside edge may bite slightly into the face 12 of the door and ensure contact of the rim structure 66' also with the face of the door. Extending axially outwardly from the inside rose 29 is a bearing sleeve 67 which projects deeply into the recess 57 of the inside knob 28 to a position where it is adapted to bear rotatively against the wall 59. An arcuate boss 68 provides an arcuate surface 69 in a position adapted to bear against the bottom of the recess 63 and also to provide an axially outwardly facing shoulder 70 adapted to engage the inwardly facing shoulder 64 of the knob. An axially inwardly facing shoulder 71 is adapted to engage the outwardly facing shoulder 65 of the inside knob. As will be observed from the drawings, particularly FIGS. 2 and 7, the width of the recess 63 is substantially greater than the width of the boss 68 so that the inside knob 28 can shift axially an appreciable amount.

Figure 8:
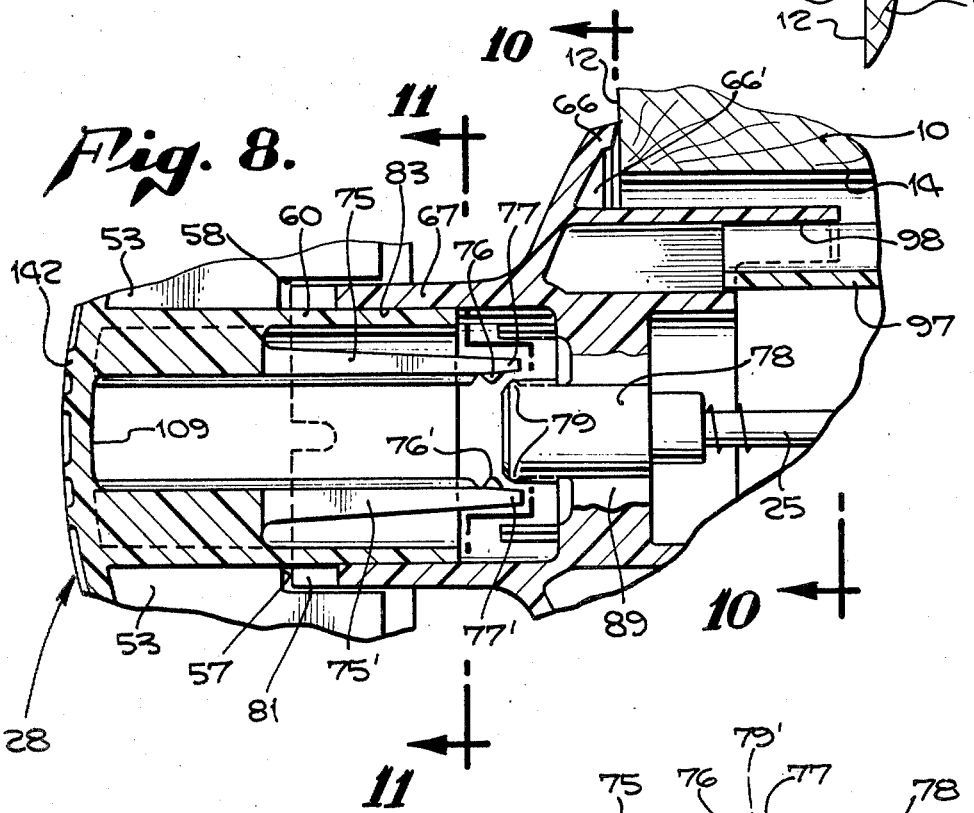
FIG. 8 is a longitudinal sectional view of the inside locking assembly on the line 8—8 of FIG. 7.
Figure 9:
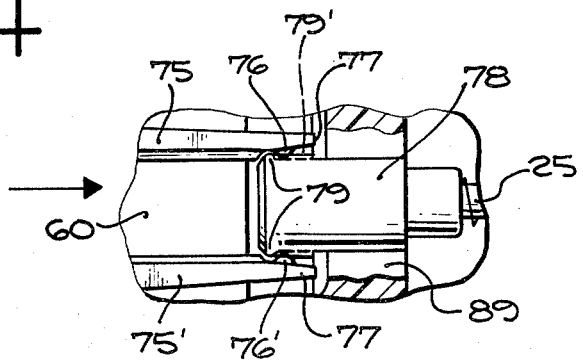
FIG. 9 is a fragmentary longitudinal section view of the inside locking assembly parts in locked position.
Figure 11:
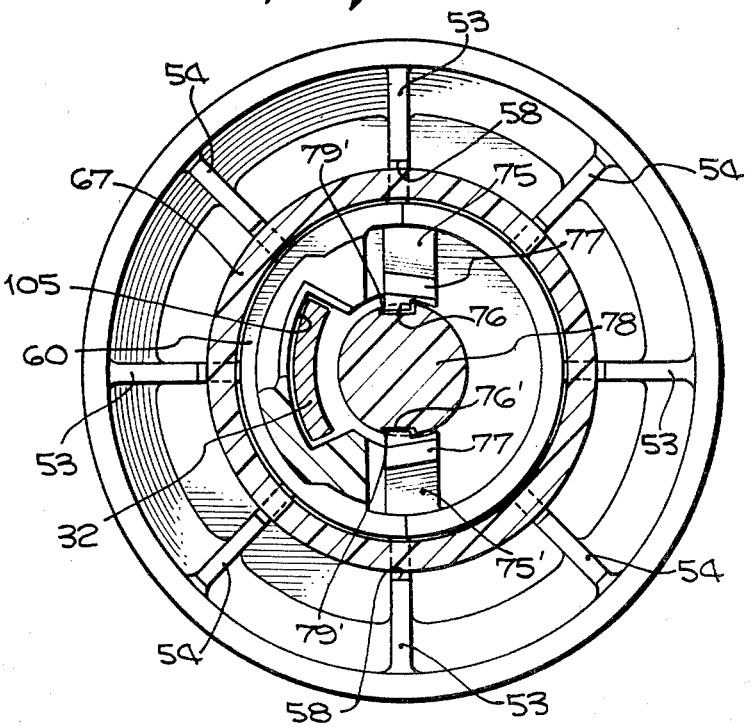
FIG. 11 is a cross-sectional view on the line 11—11 of FIG. 8 but with the knob pushed to lock position.
Figure 12:
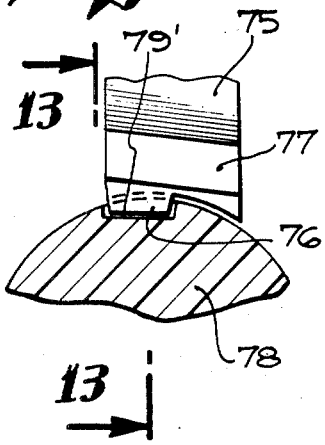
FIG. 12 is a fragmentary enlarged cross-sectional view of the "push-to-lock" form of the device showing the locking detent.

Also on the inside knob 28 are locking legs 75 and 75' best shown in FIGS. 8, 9, and 11. The locking legs 75 and 75' are resilient and have at their respective inner ends beads 76 and 76' separated axially in one direction from respective ends 77 and 77'. The beads 76 and 76' are adapted to slide over a boss 78 and enter respective channels 79' behind the corresponding locking lugs 79 in an inwardly extended locked position of the inner knob 28, as shown in FIG. 9.

Figure 7:
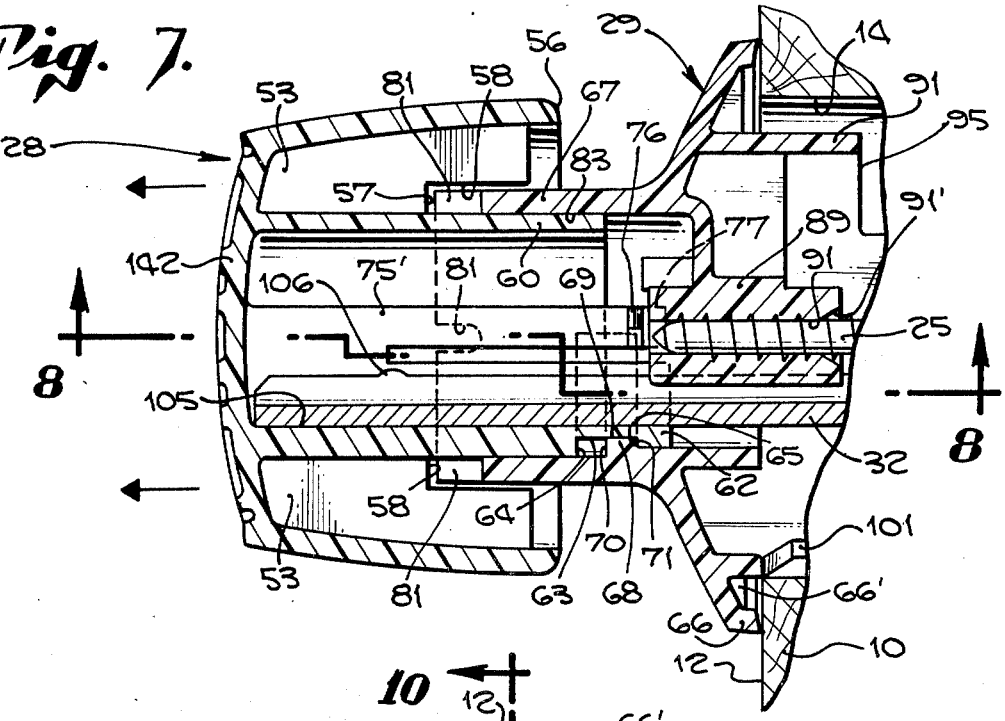
FIG. 7 is a longitudinal sectional view of the inside locking assembly in unlocked position of the push-to-lock form of the device.

To understand the locking arrangement reference is made to FIGs. 3 and 7 of the drawings where there is shown a series of circumferentially spaced axially inwardly extending notches or slots 81 at the edge of the bearing sleeve 67. Those portions of the fins 53 at the bottoms of the recesses 57 of the inside knob are adapted to project into the respective notches 81, when the inner knob 28 is pushed inwardly to the position shown in FIG. 9. By having the sleeve-like protruberances 60 slide snuggly within the interior bore 83 of the bearing sleeve 67 the locking beads 76, 76' are effectively centered with a minimum amount of wear.

The interlocking relationship locks the inner knob against rotation. When the inner knob is projected inwardly from the position of FIG. 8 to the position of FIG. 9, the beads 76 and 76' are flexibly deflected by the locking lugs 79 until they override the locking lug and are releasably detained in the inwardly extended position, namely the position in which the respective fins 53 are in the notches 81. In addition the sleeve 60 has a semicircular segment 72, the edges of which must align with corresponding edges of the arcuate boss 68 before the fins 53 can enter the notches 81. The breadth of the recess 63 is made such that it will accommodate an axial movement sufficient to accomplish the locking just described.

Conversely when the inner knob is to be unlocked it is merely pulled outwardly during which movement the beads 76 and 76' are again deflected over the locking lugs 79 from the position of FIG. 9 to the position of FIG. 8 wherein the fins 53 and segment 72 are disengaged. In the outer position of FIG. 8 the inner knob is still in rotatable engagement with the inside rose 29 by reason of the sliding fit of the protruberance 60 in the bearing sleeve 67.

In unlocked position ends of the fingers beyond the beads 76, 76' overlie the annular locking lug 79 so that when the knob is pushed upon the fingers 75, 75' do not hang up and cause the fingers to buckle.

The push-to-lock feature just described is designed to operate when the spindle 32 is at rest with the latch bolt fully extended. As a precaution against inadvertent locking a slightly modified arrangement of the structure of the locking parts may be made such that the inside knob 28 must be rotated slightly before being pushed to lock. A rotation of about 7° to 11° has been found acceptable.

Figure 14:
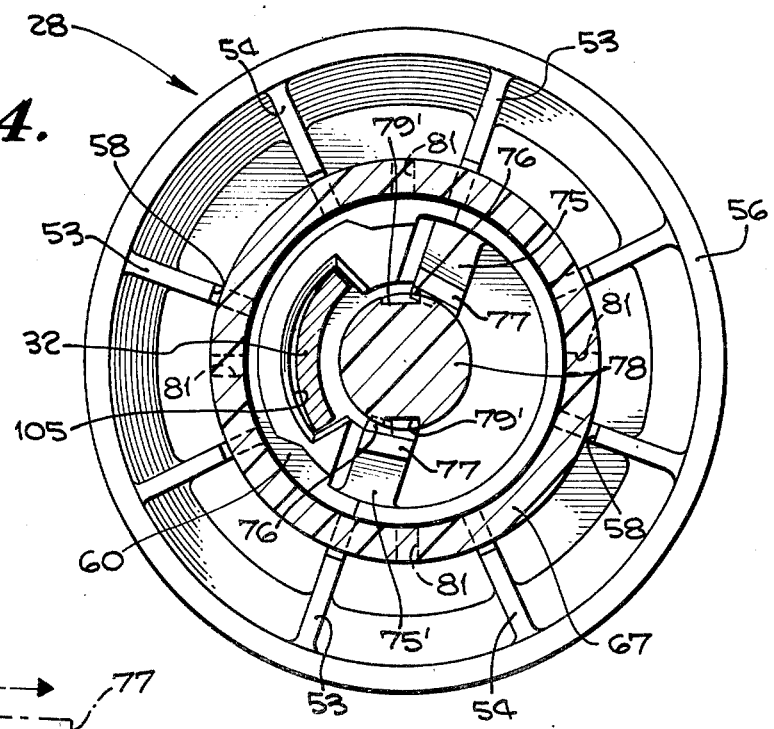
FIG. 14 is a cross-sectional view similar to FIG. 11 but revised to provide a "turn and push to lock" movement, in unlocked position.
Figure 16:
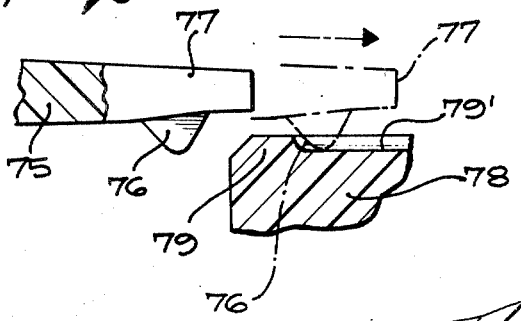
FIG. 16 is a fragmentary longitudinal sectional view on the line 16—16 of FIG. 15.
Figure 15:
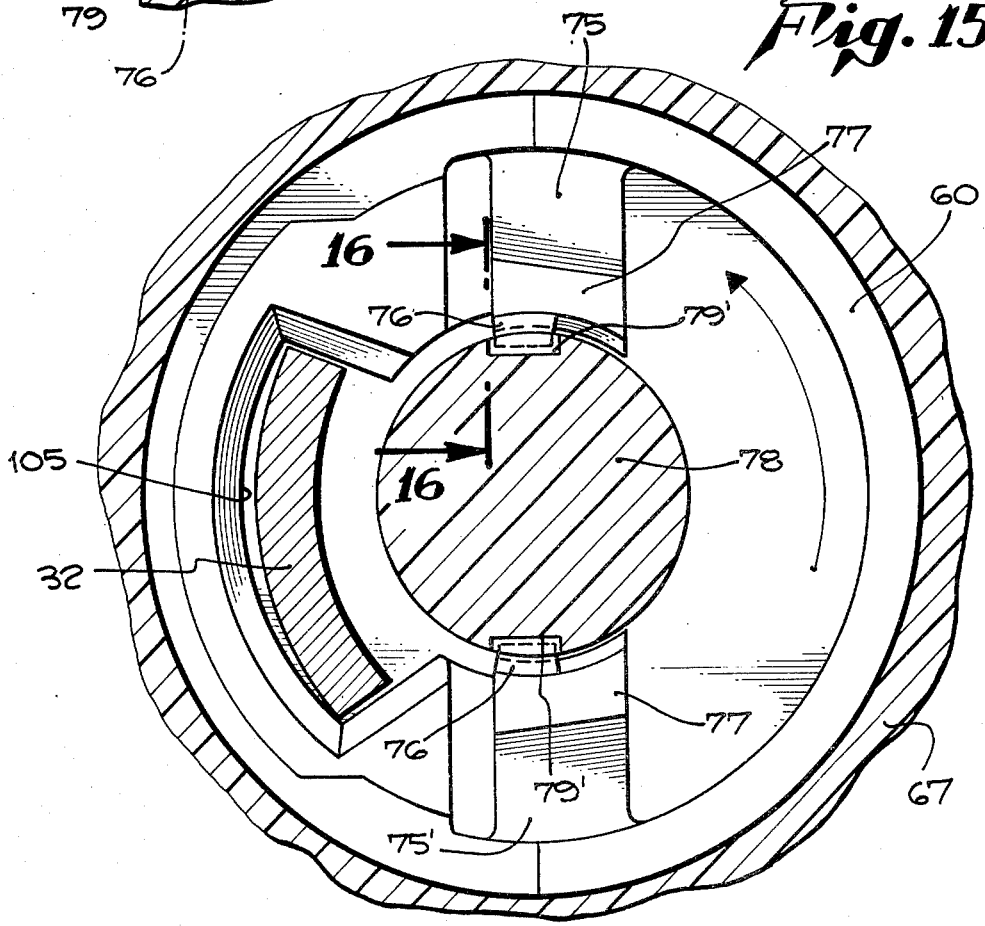
FIG. 15 is a cross-sectional view similar to FIG. 14 but in the turned and ready to lock position.
Figure 17:
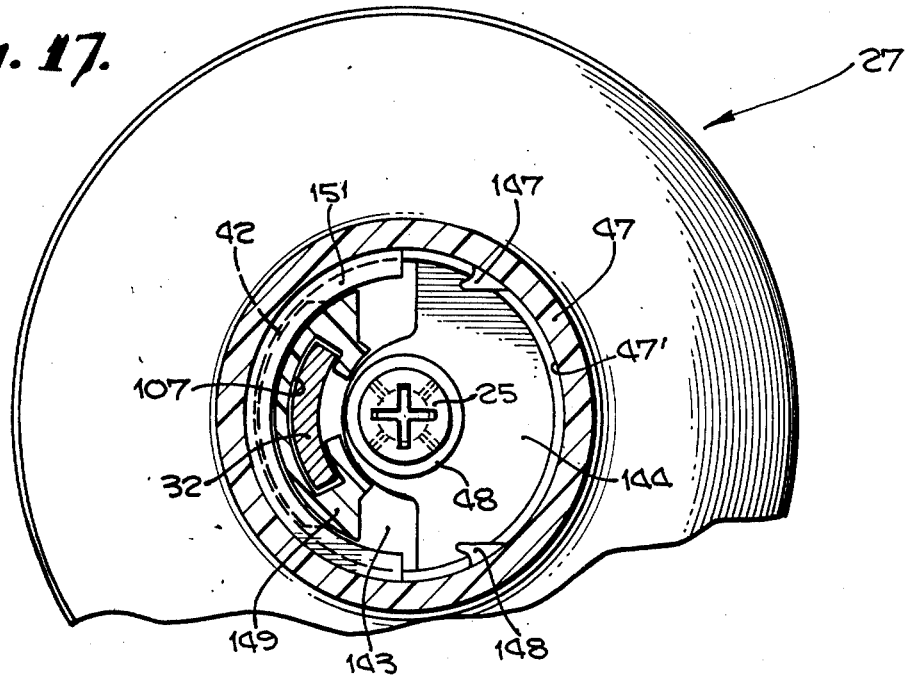
FIG. 17 is a cross-sectional view on the line 17—17 of FIG. 2 showing the knob retention structure.

The turn and push arrangement is shown in FIGS. 14, 15 and 16 and is accomplished by rotationally off-setting the spindle location with respect to register of the notches 81 with the corresponding fins 53, and the semicircular segment 72 with the corresponding arcuate boss 68 with the off-set slightly exaggerated for the purrpose of illustration. As shown in FIG. 14 theinside knob 28 and spindle 32 is at rest, as would be the position of parts when the latch bolt 31 is fully extended with a latch bolt head 111 in the latch bolt opening 19 of the strike plate 18. The knob 28 cannot be pushed to lock in this position.

When the latch bolt is to be locked the knob 28 is rotated, clockwise, a distance of about 7° to 11°, from the position of FIG. 14 to the position of FIG. 15. The rotational movement brings the fins 53 into alignment with the notches 81 and the semicircular segment 72 with arcuate boss 68 and simultaneously brings the beads 76, 76', into alignment with the respective channels 79' of the corresponding locking lugs 79. The knob 28 can then be pushed into locking position wherein the fins 53 engage in respective slots 81 and the semicircular segment engages past the arcuate boss 68.

With an adequate normal amount of extension of the latch bolt 31 the amount of withdrawal due to the 7° to 11° rotation is negligable from the point of view of security for locks of this description.

For anchoring the two roses in position on the door and engagement with each other there is only the single screw 25 already identified. In the outside knob there is a central passageway 85 larger in diameter than the head of the screw to which access is had for a screw driver through a hole 86 in an end wall 87 of the outside knob. The hole 86 is preferably smaller than the head of the screw.

In the mass 51 of the outside rose there is a passageway 88 in axial alignment with the passageway 85 having a diameter large enough to snuggly accommodate the screw. A web or protrusion of material in the passageway 88 (not shown) may be employed to temporarily hold the screw 25 out of engagement with, but in alignment with, a screw hole 90 in a mass 89 of the inside rose 29. A flared opening 91' serves to direct the screw 25 into the hole 89. The screw hole 90 is small enough so that a thread forming screw like the screw 25 can be employed to thread its way into the screw hole 90 to hold the parts together. By making the hole 86 smaller than the head of the screw the screw can not fall out and get lost. The two subassemblies are attached together in this fashion as they are fastened in position on the door.

Figure 10:
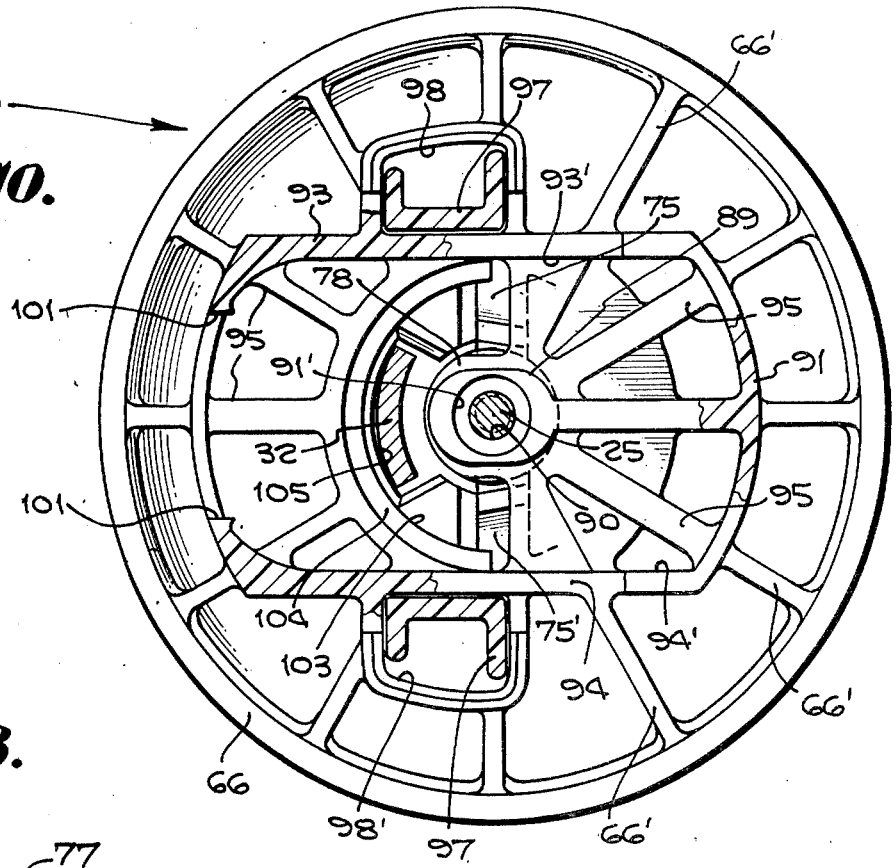
FIG. 10 is a cross-sectional view on the line 10—10 of FIG. 8.
Figure 13:
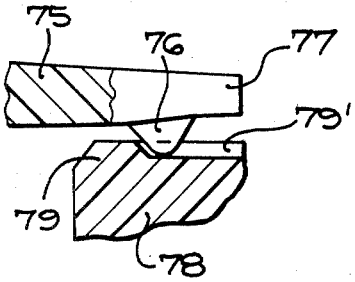
FIG. 13 is a longitudinal sectional view on the line 13—13 of FIG. 12.

There is appreciable reinforcing structure forming part of the inside rose 29 embodied in arcuate walls 91 and 92 and straight walls 93 and 94 as shown advantageously in FIG. 10. Circumferentially spaced radially extending fins 95 interconnect the walls 91, 92, 93, and 94 with the mass 89. Other circumferentially spaced and radially extending fins 66' interconnect the walls 91, 92, 93, and 94 with the rim 66 of the inside rose, as shown in FIG. 10. Edges 101 of the wall 92 engage slots 102 in the latch bolt case 30 to hold parts together. A dove tail fit as shown inhibits disengagement.

An arcuately extending space 103 formed in part by a wall section 104 of the inside rose provides for rotation of the spindle 32.

To prevent the inside rose 29 from rotating relative to the outside rose 27 after they have been anchored in position as previously described, channel sections 97 and 97' are provided on the outside rose 27 and these are adapted to be received in respective complementary pockets 98 and 98' on the inside rose. Further still to center the inside rose in the opening 14 in the door and by this, center the entire assembly, outside surfaces of the pockets 98 and 98' and the arcuate walls 91 and 92 have substantially the same curvature as the opening 14.

To accommodate the spindle 32 there is provided in the inside knob 28 an arcuate pocket 105 which has a cross sectional area and size complementary with respect to the cross sectional area and size of the spindle 32. The spindle is additionally provided with a pair of projections 106 which establish a frictional engagement with the walls of the arcuate pocket so that once the spindle has been pushed into position in the inside knob it will not readily fall out. Similarly the outside knob 26 is provided with an arcuate pocket 107 into which the outside end of the spindle 32 can freely enter. The spindle is of such length that one end 108 bottoms against an end wall 109 of the inside knob. No attempt is made to have the opposite end of the spindle bottom against the end wall 87 of the outside knob 26 because when doors of different thickness are encountered the position of the spindle 32 in the arcuate pocket 107 changes. When the knobs are interconnected by the spindle 32 as described both rotate simultaneously when one or the other is rotated.

In essence rotation of the knobs is for the purpose of withdrawing the latch bolt 31. The latch bolt is specially constructed for this purpose. As shown in FIGS. 3 and 21–24 the latch bolt consists of a shaft member 110 at one end of which is the latch bolt head 111 of customary design. The other end of the shaft 110 is bifurcated to provide a pair of resilient arms or bolt tails 112 and 113. The resilient arm 112 has a shoulder 114 facing the spindle 32 at an adjacent edge 115. Adjacent the shoulder 114 is an oblique camway 116 along which the edge 115 of the spindle is adapted to travel. Similarly on the resilient arm 113 is a shoulder 117 adjacent an opposite parallel edge 118 in the spindle 32 with a similar camway 119 along which the edge 118 is adapted to travel. When the spindle is rotated by operation of one or the other of the knobs from the position of FIG. 22 to the position of FIG. 23 the latch bolt head 111 is withdrawn subject to subsequent extension by appropriate spring action.

Figure 21:
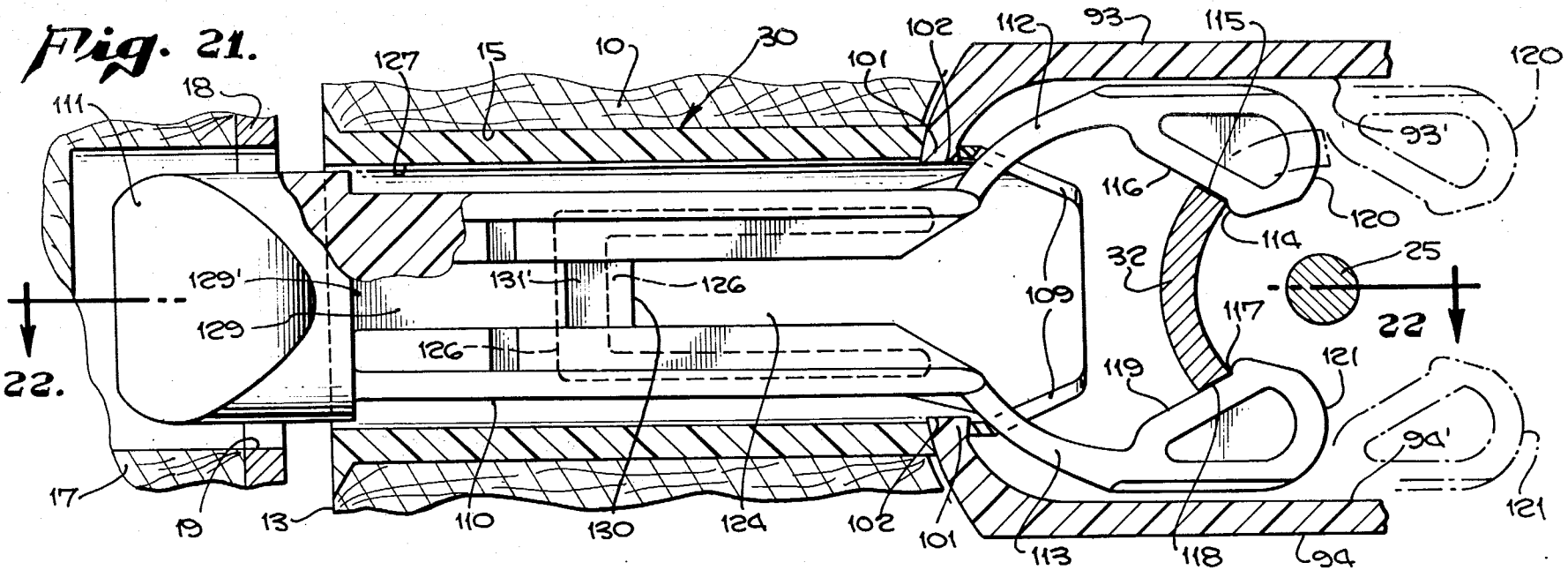
FIG. 21 is a longitudinal sectional view of the latch bolt subassembly in extended position on the line 21—21 of FIG. 2.
Figure 22:
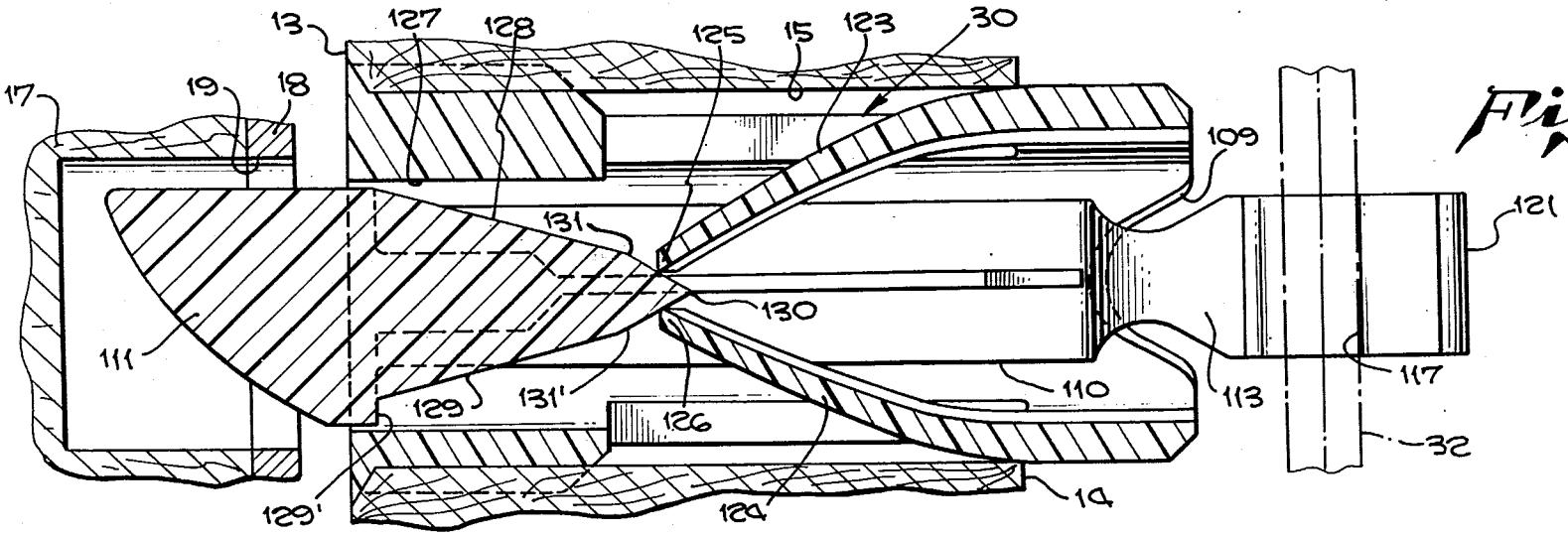
FIG. 22 is a longitudinal sectional view on the line 22—22 of FIG. 21.
Figure 23:
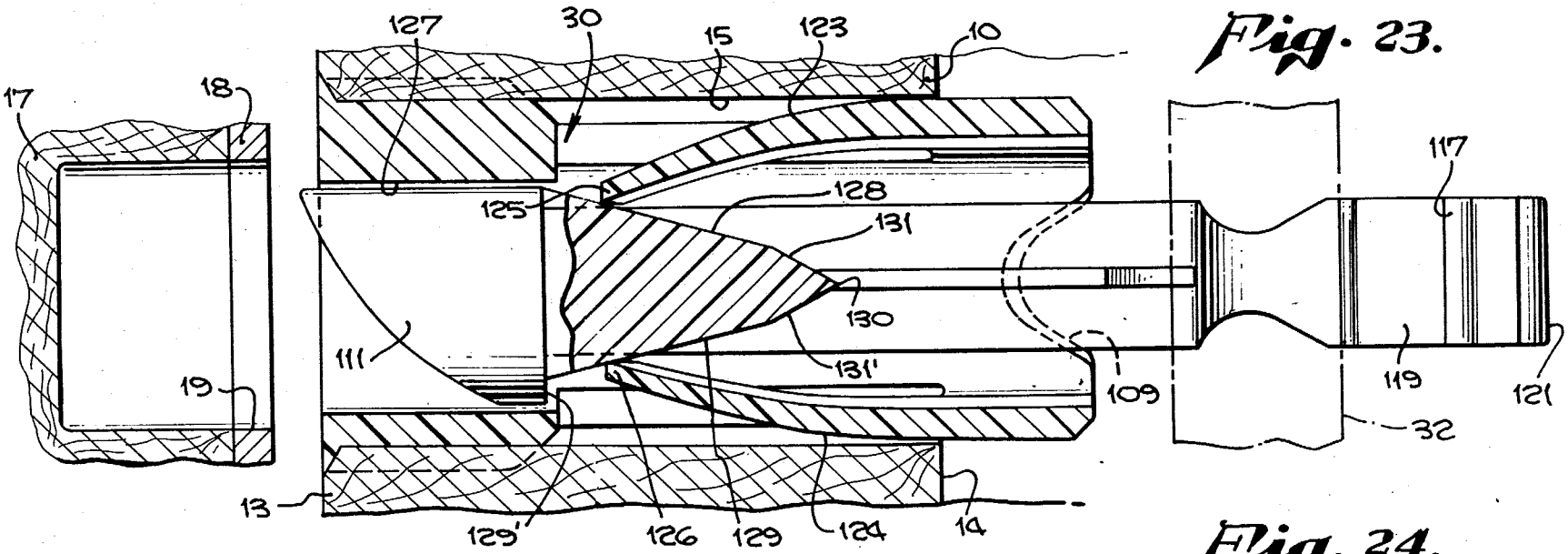
FIG. 23 is a longitudinal sectional view similar to FIG. 22 but in retracted position.

It should be noted, however, that ends 120 and 121 of the respective resilient arms are spaced wide apart and do not encompass the screw 25 except at the innermost extension of the latch bolt as shown by the broken lines in FIG. 21. Notches 109 in the case 30 receive arms 112, 113 when extended.

Figure 24:
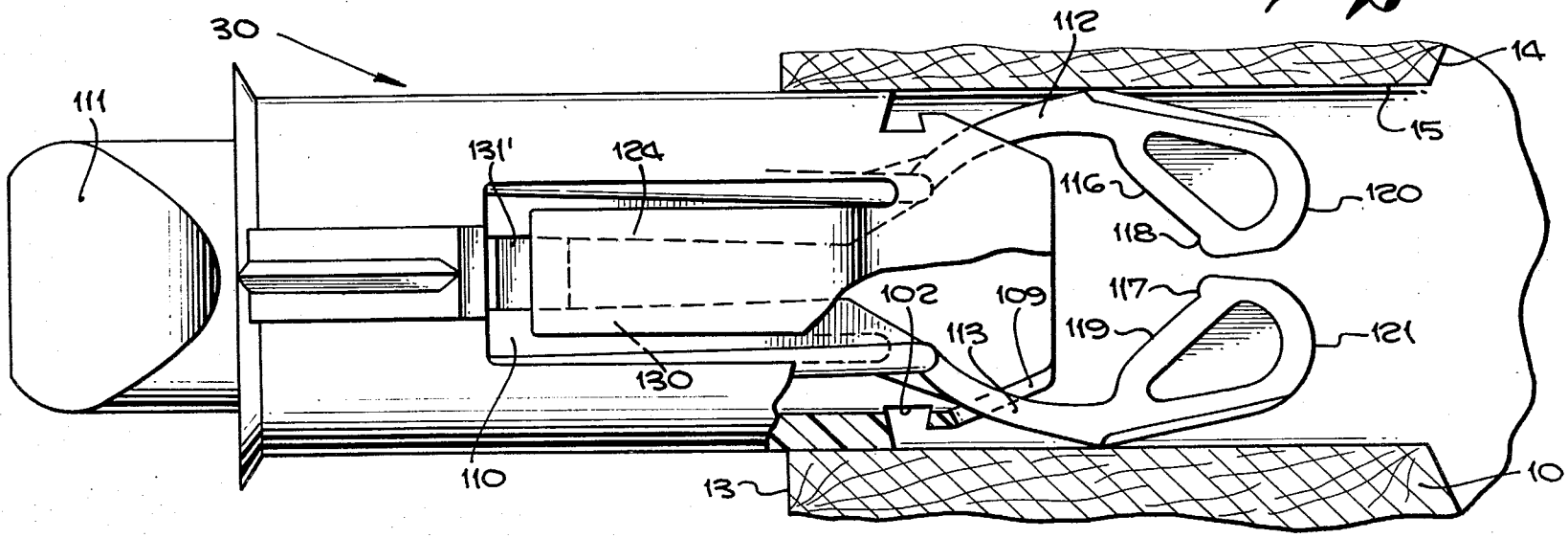
FIG. 24 is a longitudinal sectional view of the latch bolt subassembly during insertion into the door.

As shown in FIG. 24 there is sufficient clearancce between the arms 112 and 113 to permit them to be forced together close enough to permit the latch bolt to be passed through the door edge bore 15 of substantially minimum diameter. To adequately confine and position the arms 112 and 113 the outside surfaces are made to slide along complementary surfaces 93' and 94' respectively of the walls 93 and 94, see FIG. 21. However, the arms 112 and 113 cannot be forced close enough together to allow them to pass forward into a guide bore 127 of case 30. Hence the bolt cannot be inadvertently dismantled.

To provide the necessary spring action to return the latch bolt to extended position there are provided on the case 30 a pair of spring legs 123 and 124. These spring legs are made of the same material as the case 30 and are in effect cut out of the wall of the case. The legs terminating respectively in free ends 125 and 126 extend inwardly into the guide bore 127 of the case, see FIG. 3. Immediately at the rear of the bolt head 111 there are two ramps 128 and 129 back to back which converge to an inner end 130. The end 125 of the spring leg 123 is adapted to ride on the ramp 128 and the end 126 of the spring leg 124 is adapted to ride on the ramp 129. There is additionally provided ramps 131 and 131' at a steeper angle adjacent the inner end 130 which serve to more effectively build up spring tension during initial withdrawing movement of the latch bolt 111. This compensates for a diminishing effectiveness of the spring legs 123 and 124 as they approach their relaxed position.

A shoulder 129' at the head end of the ramp 129 by engagement with the end of the respective finger 124 prevents inadvertent disassembly of the shaft member 110 from the case 30.

When the latch bolt including the latch bolt head is withdrawn by rotation of the spindle the ends 125 and 126 slide up the respective ramps 128 and 129 building up tension in the spring legs 123 and 124 as they approach opposite ends of the ramps. When the spindle is released energy built up in the spring legs causes them to press against the respective ramps and by this pressing or squeezing action to extend the latch bolt head outwardly again to the position shown in FIGS. 21 and 22.

For locking the plastic lock when it is structured as a privacy lock as described in detail locking is accomplished when the spindle is locked against rotation. To so lock the spindle the inside knob 28 is pushed inwardly as has been previously described. Should the door be inadvertently locked when in the open position no damage is done to the lock set should the door be closed and the latch bolt be driven back because movement of the arms 112 and 113 will not be impaired by either the spindle 32 or the screw 25.

For unlocking the lockset from the outside of the door, more commonly known as emergency release, there is provided an opening 135 in the end wall 87 of the outside knob 26, the opening being in alignment with the spindle 32. An appropriate tool such, for example, as a rod 136 can be inserted through the opening 135 and pressed against an adjacent end edge 137 of the spindle 32 which in turn pushes against the end wall 109 of the inside knob 28 causing the beads 76 and 76' to be disengaged from the annular lock lugs 79 at which time the fins 53 are disengaged from the notches or slots 81 and the semicircular segment is disengaged from boss 68. As a result the inside knob 28, and the outside knob 26 as well, are then free to be rotated for withdrawal of the latch bolt. A slot 134 in the inner sleeve 41 serves to guide the rod 136 as it is pushed against the spindle 32 and a step 138 in the end edge of the spindle also helps center the rod 136 in alignment with the spindle.

Figure 4:
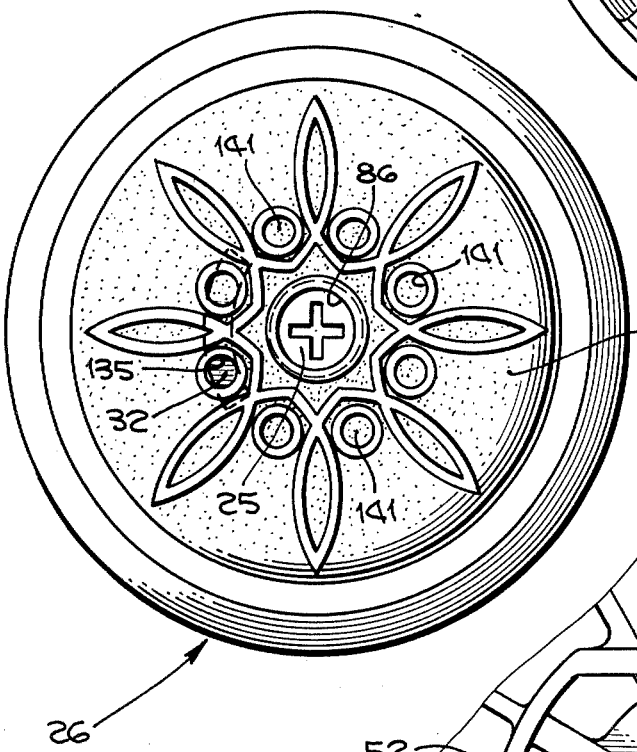
FIG. 4 is a right end elevational view on the line 4—4 of FIG. 2.
Figure 6:
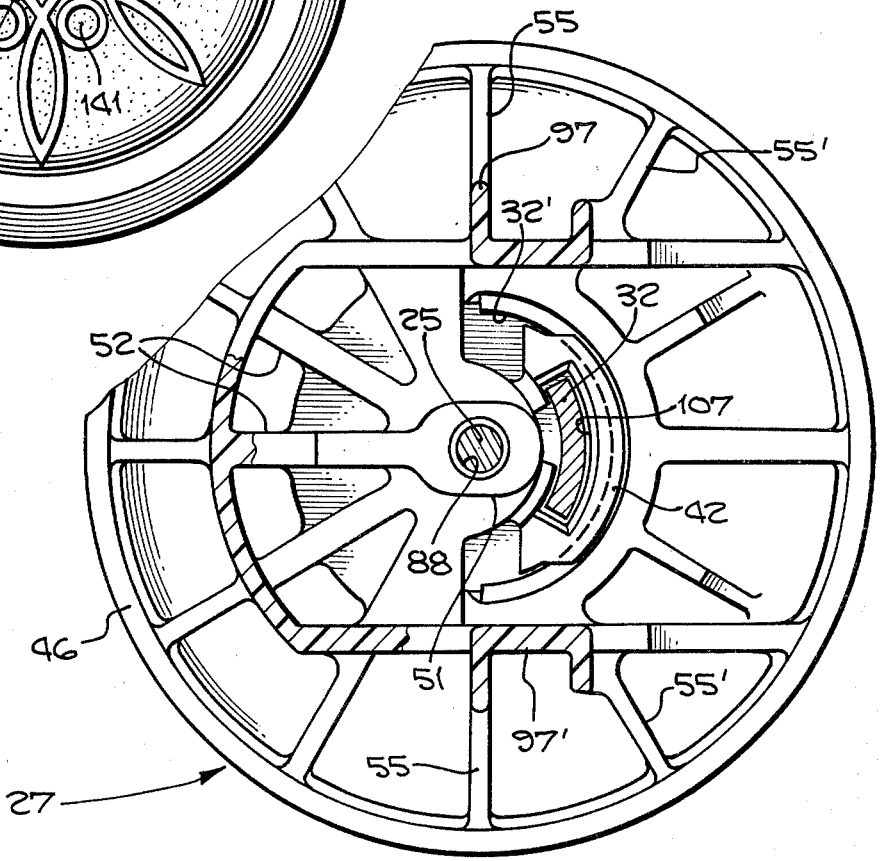
FIG. 6 is a cross-sectional view on the line 6—6 of FIG. 2.

As shown in FIG. 4 an end face 140 of the outside knob 26 can be provided with a design presenting a series of blind recesses 141 which are similar in appearance to the opening 135. Sundry varied designs may be selected. An end face 142 of the inside knob 28 may carry a comparable design.

Prior to assembly of the outside rose and knob with the inside rose and knob on the door the latch bolt is inserted. The spindle then is projected into the space between the resilient arms 112 and 113 of the latch bolt. The case 30 is effectively interlocked with the other working parts and secured in the appropriate rose in the door by interlocking dovetail edges 101 of rose 29 with the dovetail slots 102 on case 30. It follows, therefore, that all of the components parts are attached to each other and in proper position on the door in a quick, single operation by merely assembling them in position in the door and then securing them by employment of a single screw.

In each instance the knob, whether outside or inside knob, may be preassembled on the corresponding rose in a manner permitting disassembly whenever necessary. For illustrative purposes the structure enabling such preassembly is shown in FIGS. 17, 18, 19 and 20 as applied to the outside knob 26 and outside rose 27, FIG. 17 being taken on the line 17—17 of FIG. 2 with the knob already in place on the rose and the spindle engaged.

Ultimate assembly results in engagement of the arcuate projection 42 of the knob with an arcuate ledge 145 of the rose. There is a shoulder 150 on one side of the arcuate ledge 145 and on the opposite side a shoulder 151. The arcuate projection 42 forms an arcuate engagement of something less than 180°. Immediately adjacent is an accommodation space 144.

Figure 18:
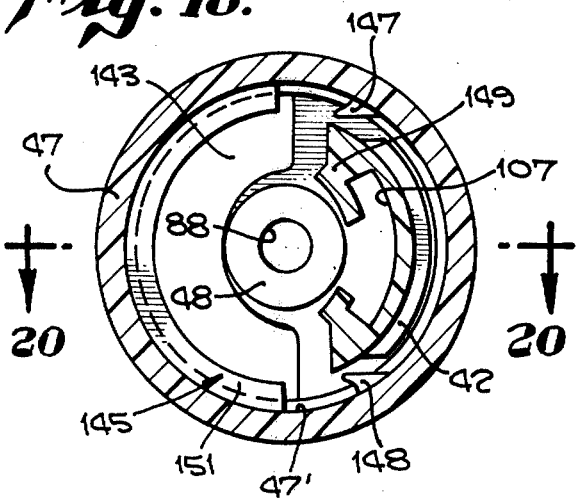
FIG. 18 is a cross-sectional view at the same location as FIG. 17 but with parts in the position occupied prior to sub assembly.
Figure 19:
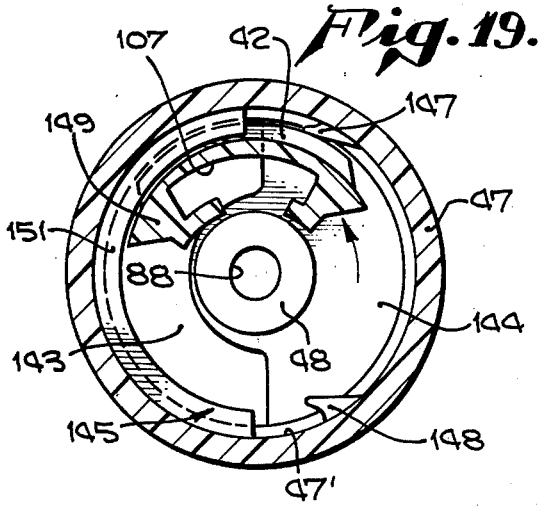
FIG. 19 is a cross-sectional view similar to FIG. 18 showing initial movement to accomplish assembly.
Figure 20:
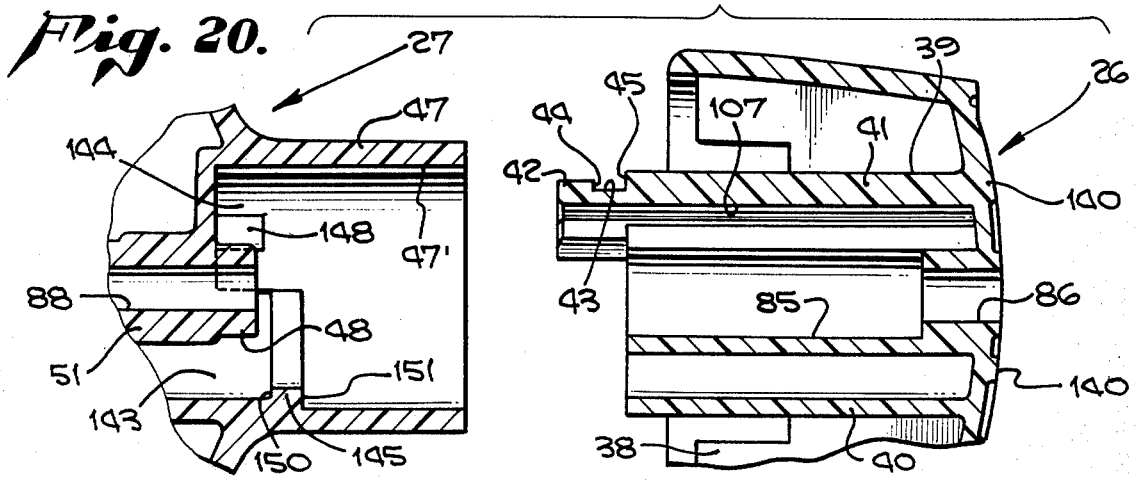
FIG. 20 is an exploded view on the line 20—20 of FIG. 18.

With the parts in the position of FIG. 20 and the spindle removed, the knob is projected into the rose until the projection 42 and its shoulder 44 underlie the shoulder 150 of the ledge 145. The rotational arrangement is as shown in FIG. 18 wherein the accommodation space 144 receives the mass 149 of the inner sleeve 41. The knob is then rotated in either direction to the position shown in FIG. 19.

Rotation, for example counterclockwise, causes the projection 42 to be forced against a detent 147. A second detent 148 is provided in case the rotational direction is reversed. The inner sleeve 41, the projection 42 and the detent mutually yield as the sleeve 41 is moved to a position under the ledge 145 where a clearance space 143 accommodates the mass 149.

After the projection 42 passes from engagement with the detent the inner sleeve 41, the projection 42 and the detent resume their initial position, and projection 42 is lodged in rotational engagement with the ledge. Ultimately with the spindle in place as in FIG. 17 the knob cannot be disassembled, due to the spindle prohibiting excess rotation.

Without the spindle in place opposite ends of the projection 42 will abut against one or another of the detents 147, 148 to prevent inadvertent disassembly of the knob from the rose.

When ultimate disassembly is desired, and with the spindle removed, the knob is rotated either clockwise or counterclockwise. In clockwise direction the detent 147, the inner sleeve and the projection again mutually yield until the projection reaches the position of FIG. 18. In counterclockwise direction it is the detent 148, sleeve and projection which mutually yield. The knob is then free for removal from the rose. The inside knob, whether for the passage lock or for either of the lock type modifications, is assembled and disassembled from its respective rose in the same fashion and by use of the same structure.

Having described the invention what is claimed as new in support of Letters Patent is as follows:

1. A lock for a door which has an opening between outside and inside faces and a bore extending from a side edge transversely into said opening, said lock comprising for the outside end of said opening an outside rose member with an outside knob member having a rotatable retention mounting on said outside rose member, an inside rose member for the inside end of said opening with an inside knob member having a rotatable retention mounting on said inside rose member, said knob members having a common axis of rotation between latched position and unlatched position a single piece spindle interconnecting said knob members, a latch bolt subassembly in said bore including a case and a latch bolt, said latch bolt subassembly including a shaft and bolt head reciprocatably mounted in said case, the long axis of the latch bolt subassembly being in transverse alignment with the axis of rotation of said knob members, attachment means adapted to fasten said rose members together on the door, complementary engageable elements on the respective rose members for preventing relative rotation between said rose members, said spindle having opposite ends in non-rotatable engagement with the respective knob members and a retract shoulder of said knob members on the side of said axis of rotation adjacent said latch bolt head, said spindle having the longitudinal axis thereof normally in transverse alignment with the long axis of the latch bolt subassembly, said long axis of the latch bolt subassembly having a location extending through said spindle and the axis of rotation of said spindle, a lateral clearance in each rose member through which said spindle extends to allow for rotation of the spindle, rollback means on the inside end of the latch bolt shaft comprising a yieldable arm adjacent said spindle, said arm having a fixed end on the latch bolt shaft and a free end, and a rollback shoulder on the free end of said arm facing the retract shoulder of said spindle and on the side of said axis of rotation adjacent said latch bolt head, said rollback shoulder being adapted to be shifted inwardly with the latch bolt pass said axis of rotation upon rotation of said spindle by operation of either of said knob members.

2. A lock for a door as in claim 1 wherein there is a centrally disposed boss on one of said rose members having an axially extending hole, and an axially aligned hole in the respective knob member, said attachment means for fastening said rose members comprising a single fastening element insertable in said hole in the boss and a complementary fastening element in the other rose member adapted for reception of said first identified fastening element, said free end of said arm being spaced from and clear of said attachment means.

3. A lock for a door as in claim 2 wherein the first identified fastening element is a screw preassembled with the respective rose and knob member, said hole in the knob member being a clear hole and there is a restriction in the outside end of said clear hole and a head on said screw larger than said restriction whereby the screw is trapped between the outside rose and knob members and said screw and said outside knob and rose members are in subassembled relationship.

4. A lock for a door as in claim 1 wherein said spindle has an arcuate midportion and opposite longitudinal edges each comprising a retract shoulder with said midportion normally passing through the long axis of the latch bolt, said rollback means comprising two laterally spaced yieldable arms with a rollback shoulder on each arm for engagement by a respective retract shoulder of the spindle.

5. A lock for a door as in claim 1 wherein said latch bolt comprises a shaft member having a central longitudinal axis, a bolt head at one end of the shaft member and said rollback means at the other end of the shaft member, said rollback means comprising a resilient arm with a free end spaced laterally from said longitudinal axis and on one side of the spindle with a shoulder on an inner side of said free end adapted to face an edge of the spindle, said case comprising a sleeve member having a guide bore mounting said shaft, one of said rose members at a location adjacent the rollback means having a guide way facing toward said longitudinal axis, an outer side of said resilient arm having a laterally outwardly directed sliding retaining engagement with said guide way during movement of said latch bolt, and spring means acting between said shaft and sleeve member biased in a direction urging said latch bolt axially outwardly.

6. A lock for a door as in claim 5 wherein said sleeve member has a cylindrical wall of substantially uniform thickness and said spring means comprises a ramp on one of said shaft and sleeve members and a spring leg on the other of said shaft and sleeve members having a free end in sliding relationship with said ramp.

7. A lock for a door as in claim 6 wherein there is a different angle for the ramp at one end of said ramp adapted to vary the spring energy build up in said spring leg during movement of said latch bolt and the knob members between latched and unlatched positions.

8. A lock for a door as in claim 7 wherein the ramp is on the shaft member and the spring means is on the sleeve member.

9. A lock for a door as in claim 6 wherein there are two ramps back to back on said one shaft and sleeve members and two spring legs on the other of said shaft and sleeve members pressing one against each ramp, said spring legs being portions of the cylindrical wall of said sleeve member, said spindle having opposite longitudiinal edges each comprising a retract shoulder there being two resilient arms on B1 opposite sides of the shaft member, one of said retract shoulders being engageable with one of said resilient arms and the other of said retract shoulders being engageable with the other resilient arm.

10. A lock for a door as in claim 5 wherein the spindle has longitudinally extending parallel side edges and the rollback means comprises two resilient arms spaced from each other and on opposite sides of the spindle at locations removed from said single fastening element, each of said arms having a shoulder facing the respective edge of the spindle enabling withdrawal of said latch bolt by rotation of said spindle in either direction, there being two guide ways on said one of said rose members in positions facing each other slidably retaining the respective resilient arms during movement of the latch bolt.

11. A lock for a door as in claim 10 wherein there is an outwardly facing sliding face on each arm, said guide ways comprising inwardly facing sliding surfaces in face to face position on one of said rose members, there being a sliding surface for each of said arms and adapted to retain said arms in restricted sliding relationship with the respective rose member.

12. A lock for a door as in claim 10 wherein walls extend axially inwardly from the side of one of said rose members forming a chamber, one of said walls having a pair of spaced parallel edges forming a space therebetween, said latch bolt case having spaced parallel slots on respective opposite sides adapted to slidably receive said edges, the rollback means on said latch bolt being completely housed in said chamber when the edges are in engagement with said slots, inside faces of opposite walls having the respective guide ways thereon for the slidable retention of said resilient arms.

13. A lock for a door which has an opening between outside and inside faces and a bore extending from a side edge transversely into said opening, said lock comprising for the outside end of said opening an outside rose member with an outside knob member having a rotatable retention mounting on said outside rose member, an inside rose member for the inside end of said opening with an inside knob member having a rotatable retention mounting on said inside rose member, said knob members having a common axis of rotation between latched and unlatched position, a single piece spindle interconnecting said knob members, a latch bolt subassembly in said bore including a case and a latch bolt, said latch bolt subassembly including a shaft and bolt head reciprocatably mounted in said case, the long axis of the latch bolt subassembly being in transverse alignment with the axis of rotation of said knob members, attachment means adapted to fasten and rose members together on the door, complementary engageable elements on the respective rose members for preventing relative rotation between said rose members, said spindle having opposite ends in non-rotatable engagement with the respective knob members and a retract shoulder of said spindle being spaced radially from the axis of rotation of said knob members on the side of said axis of rotation adjacent said latch bolt head, said spindle having the longitudinal axis thereof normally in transverse alignment with the long axis of the latch bolt subassembly, a lateral clearance in each rose member through which said spindle extends to allow for rotation of the spindle, rollback means on the inside end of the latch bolt shaft comprising a yieldable arm adjacent said spindle, said arm having a fixed end on the latch bolt shaft and a free end, and a rollback shoulder on the free end of said arm facing the retract shoulder of said spindle and on the side of said axis of rotation adjacent said latch bolt head, said rollback shoulder being adapted to be shifted inwardly with the latch bolt past said axis of rotation upon rotation of said spindle by operation of either of said knob members the rotatable retention mounting of respective complementary rose and knob members comprising an axial passage in one of said members extending arcuately a distance of substantially 180° and a shoulder element projecting laterally of the said member, the other of said members having an arcuately extending detent element, one of said elements being adapted to flex laterally with respect to the other of said elements during initial partial rotation of members whereby to enable subassembly engagement of the knob member with the rose member.

14. A lock for a door as in claim 13 wherein the axial passage is in the knob member and the shoulder element shifts flexibly relative to the projection element.

15. A lock for a door as in claim 13 wherein there is an axially extending clearance adjacent the respective elements of the inside rose and knob members providing an axially sliding relationship, complementary lock detent means respectively on the inside rose and knob members adapted for releasable engagement when the inside knob member is in an axially inwardly extending position, and mutually engageable radially extending lock shoulder elements respectively on the knob and rose members preventing rotation of the knob members when in axially inwardly extending position.

16. A lock for a door as in claim 15 wherein there is a hole in the outside knob member in alignment with the spindle for reception of an elongated tool for displacing the inside knob member axially to unlocked position by movement of the spindle.

17. A lock for a door which has an opening between outside and inside faces and a bore extending from a side edge transversely into said opening, said lock comprising for the outside end of said opening an outside rose member with an outside knob member having a rotatable retention mounting on said outside rose member, an inside rose member for the inside end of said opening with an inside knob member having a rotatable retention mounting on said inside rose member, a spindle interconnecting said knob members, a latch bolt subassembly in said bore including a case and a latch bolt reciprocatably mounted in said case, attachment means adapted to fasten said rose members together on the door, complementary engageable elements on the respective rose members for preventing relative rotation between said rose members, the spindle having opposite ends in non-rotatable engagement with the respective knob members and a retract shoulder of said spindle being spaced radially from the axis of rotation of said knob members, a lateral clearance in each rose member through which said spindle extends to allow for rotation of the spindle, a rollback on the inside end of the latch bolt comprising a yieldable arm adjacent said spindle, and a shoulder on the free end of said arm facing the retract shoulder of said spindle adapted to be shifted inwardly wih said latch bolt upon rotation of said spindle by operation of either of said knob members, and wherein there is an axially extending clearance adjacent the respective shoulders of the inside rose and knob members providing an axially sliding relationship, a pair of detent shoulders respectively on the inside rose and knob members adapted for releasable engagement when the inside knob member is in an axially inwardly extended position, mutually engageable radially extending lock shoulders respectively on the knob and rose members preventing rotation of the knob members when in axially inwardly extending position, said lock shoulders having a rotationally offset relationship when the inner knob member is in initially at-rest position with the latch bolt extended, said lock shoulders having an engageable relationship when said inside knob member is in a position rotationally removed from said initial rest position.

18. A lock for a door as in claim 17 wherein mutually engaging tooth and slot means on the knob and rose members form the lock shoulders.

19. A lock for a door as in claim 17 wherein spring means in the lock acting in a direction productive of rotation of the inside knob member in a direction opposite to the direction of rotation of the knob member for withdrawing the latch bolt is the agency for returning the inside knob member to said initial at-rest position.

20. A lock for a door as in claim 17 wherein when the inside knob member is in said position rotationally removed from said initial at-rest position, said latch bolt is in a latched position extended to substantially its full amount.

* * * * *